United States Patent [19]

Harding et al.

[11] Patent Number: 4,793,100

[45] Date of Patent: Dec. 27, 1988

[54] SLIDE LATCH FOR CABANA DOORS

[75] Inventors: George W. Harding, Clearwater, Fla.; George Hiskes, Munster, Ind.

[73] Assignee: Poly-John Enterprises Corp., Whiting, Ind.

[21] Appl. No.: 20,571

[22] Filed: Mar. 2, 1987

[51] Int. Cl.[4] ..... E05C 1/10

[52] U.S. Cl. ..... 49/394; 292/145; 292/DIG. 57; 292/DIG. 53; 292/DIG. 38

[58] Field of Search ..... 292/145, 57, DIG. 38, 292/DIG. 57, 146, 150, 147, 152, 337, DIG. 51, DIG. 53, DIG. 54, DIG. 55; 49/394

[56] References Cited

U.S. PATENT DOCUMENTS

| | | | |
|---|---|---|---|
| 338,463 | 3/1886 | Barrett | 292/145 X |
| 569,724 | 10/1896 | Oestmann | 292/145 |
| 635,031 | 10/1899 | Baker | 292/145 |
| 831,283 | 9/1906 | Hinman et al. | 292/145 |
| 838,644 | 12/1906 | Rapson | 292/145 |
| 1,574,222 | 2/1926 | Wensel | 292/145 X |
| 2,169,743 | 8/1939 | Schlage | 292/145 |
| 2,676,826 | 4/1954 | Smith | 292/175 |
| 2,692,789 | 10/1954 | Rivard | 292/DIG. 38 X |
| 3,126,218 | 3/1964 | Andrews | 292/145 X |
| 3,469,875 | 9/1969 | Ahlgren | 292/DIG. 38 X |
| 4,169,617 | 10/1979 | Koeneman et al. | 292/149 |
| 4,577,351 | 3/1986 | Harding | 4/460 |

*Primary Examiner*—Lloyd A. Gall
*Assistant Examiner*—Curtis B. Brueske
*Attorney, Agent, or Firm*—Cullen, Cloman, Cantor, Grauer, Scott and Rutherford

[57] ABSTRACT

A slide latch for latching the leading edge of a door, formed of a plastic panel, to an adjacent jamb-like member, is formed of a narrow, thin, horizontally elongated, flat plate positioned upon the door surface for sliding movement towards and away from the jamb-like member. Integral, narrow, rigid flanges, forming sled-like runners, are formed along the horizontally elongated side edges of the slider for slidable engagement with the panel surface. The slider is held within an open-ended, horizontally elongated, flattened loop that is struck-out of the panel. Stops are formed near the opposite ends of the slider for engaging the ends of the loops and thereby limiting the sliding movement of the slider. One of the stops may be enlarged to form a manual grip for moving the slider. The slider may be initially installed in, or removed for replacement from, the loop by pulling the slider with sufficient manually applied force to cause the loop to resiliently deflect to permit passage of the smaller stop through the loop. A cover panel over the struck-out area has a cut-out window, through which selected portions of indicia located on the slider can be visually seen.

10 Claims, 1 Drawing Sheet

SLIDE LATCH FOR CABANA DOORS

BACKGROUND OF INVENTION

Small-size cabanas that are used for outhouse-type toilets and similar types of small-size building constructions are typically made of plastic panels or sheets which are secured together to form the walls of the structure. A door, made of plastic panels, is hinged to a doorway opening in the cabana and is provided with a latch for holding the door in closed position. Various types of latches have been used, including slide bolts.

Such cabanas, particularly those used for outhouse-type toilets, are subject to damage by exposure to the varying weather elements, by abuses in transporting the units to and from their use sites and by careless users and vandals. As a result their inside latches are frequently broken or otherwise disabled so they are not properly usable. However, providing an inexpensive latch that is strong enough to resist breakage or weather-induced damage has been difficult and impractical. That is, a heavy and costly latching construction is needed to avoid most common damages due to changes in temperature, effects of the sum and other weathering elements, impacts and mishandling abuses. Additionally, the needed size and weight of a really sturdy unit is impractical. Consequently, during substantial portions of the time that such cabanas are used, their latches are either inoperative or do not operate easily enough for ordinary manual use.

Hence, there has been a need for a low cost, light weight inside latching construction which is sufficiently rigid and strong as to resist common weather and misuse damages. This invention herein relates to such an improved latch construction.

SUMMARY OF THE INVENTION

This invention contemplates forming a slide latch out of the plastic molding, in the shape of a thin, elongated, wide plate having a tongue-like end for engaging with a jamb member adjacent the leading edge of a door panel. The latch slider is positioned upon the inside of the door panel, for horizontally slidable movement, within a flattened loop which is struck-out of the door panel adjacent its leading edge. The slider is provided with rigid, narrow, integral side edge flanges. These flanges form sled-like runners that engage the door panel portions which they overlie. Also, these flanges rigidify and reinforce the slider plate to greatly resist breaking, warping, bending or twisting of the slider.

Further, the sled-like runners, because of their narrow line contact with the panel surfaces, substantially reduce the area of frictional contact between the slider and the panel to permit easy sliding operation with relatively light manual force. Consequently, a relatively large size slider may be used because the amount of manual force needed to operate the slider is not excessive.

The improved latch slider of this invention is formed in a simple configuration which can be easily molded of a plastic material of a type which provides a relatively slippery surface. Consequently, the cost of such sliders is low, and the weight of the slider latch construction is minimal.

The slider receiving loop may be integrally formed of a struck-out portion of the door panel. This leaves an opening in the panel which can be covered by a cover panel sheet. By providing a window in the cover panel sheet, useful indicia located upon the slider can be read through the window. For example, by imprinting the words "in use," "open" or "vacant" etc., upon the slider surface, such indicia can be read through the window by a prospective user.

One object of this invention is to provide a simplified, strong latch which is particularly resistant to damage from outdoor, adverse weather cnditions as well as damages from impacts, mishandling or vanadalism. In addition, an object is to provide a low cost construction which may be easily replaced without the use of tools, when necessary.

A further object of this invention is to provide a low friction, minimal operating force, latch slider which resists breakage, bending, twisting or warping caused by changes in temperature and other climatic conditions.

These and other objects and advantages of this invention will become apparent upon reading the following description, of which the attached drawings form a part.

DETAILED DESCRIPTION

Figure 1:
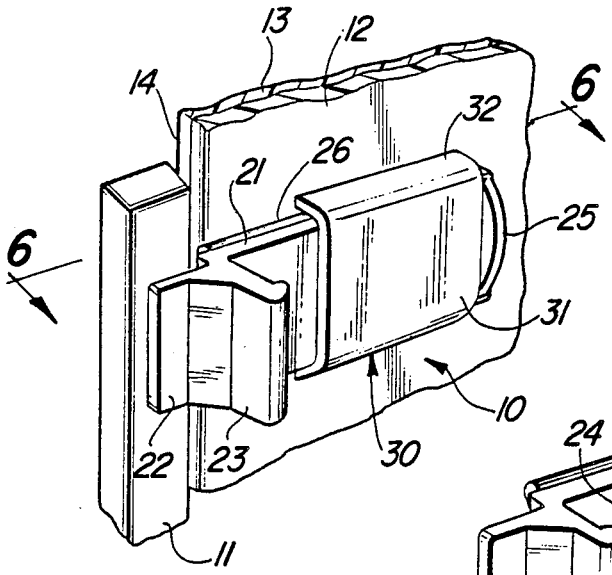
FIG. 1 is a perspective, fragmentary view of adjacent portions of a door and jamb latched together by the slide latch of this invention.

FIG. 1 schematically illustrates a door 10 latched to a jamb-like member 11, which may be the vertical frame member or jamb of a doorway, etc. In cabana or outhouse structures, such doors are typically made of large plastic panels which may be flat or may have impressed indentations formed therein. For illustrative purposes, the door 10 is shown as being formed of a thin, plastic, inner panel 12 and a plastic outer, cover panel 13. The two panels are secured together in any conventional manner. Typically, this type of door construction, utilizing inner and outer panels, has the panels provided with indentations so that the panels have portions arranged in face-to-face contact where they are joined together and other portions that are spaced apart. The particular construction of the door or the door panels is not materials to this invention and, therefore, is illustrated schematically.

Typically, in this type of door or panel construction, hinges are provided along one vertical side edge of the door (not shown) and the opposite door leading edge 14 is arranged to be aligned with the jamb-like member 11 when the door is closed.

The latch is formed of a slider 20 which has a body portion 21 that is wide, elongated, flat and thin. The leading edge of the slider is provided with a tongue 22 for engaging the jamb-like member. That engagement may simply involve the tongue abutting, in face-to-face contact, an exposed portion of the jamb-like member or, in some constructions, it may involve forming a socket in the jamb-like member to receive the tongue.

A hand grip flange 23, extending perpendicularly to the body portion 21, forms both a manual grasping means as well as a stop means, as will be further described. The free end of the flange 23 is provided with a rounded bead 24 to enable better manual grasping as well as for appearance purposes. A raised, rear rib 25 formed on the opposite end of the slider body portion 21, forms a stop or limit means.

Elongated, narrow, integral flanges 26 are formed on the outer surface of the body portion along the opposite elongated edges. These flanges form sled-like runners. For that purpose, the flanges are preferably rounded in cross-section to form rounded free edges 27.

The slider is formed of an integral plastic molding of any suitable commercially available material. However, it is desired that the surface of the slider be smooth and relatively slippery. Hence, the plastic chosen should have those characteristics. The choice of the plastic is within the knowledge of the skill of the art depending upon availability, cost, etc.

The slider is arranged upon the inner surface of the door 10, that is, the surface of the door which would be inside the cabana. The slider is fitted within a struck-out, U-shaped in cross-section receptacle 30 which is shaped like a flat loop. This forms a horizontally-oriented guide for holding the slider in position upon the door surface. The struck-out loop has a flat base 31 and integral legs 32 that join the base to the inner panel 12. Preferably, the loop is integral with the panel 12. However, the loop may also be formed as a separate member which is mechanically fastened, as by heat welding or by rivets or the like, to the panel 12.

Figure 4:
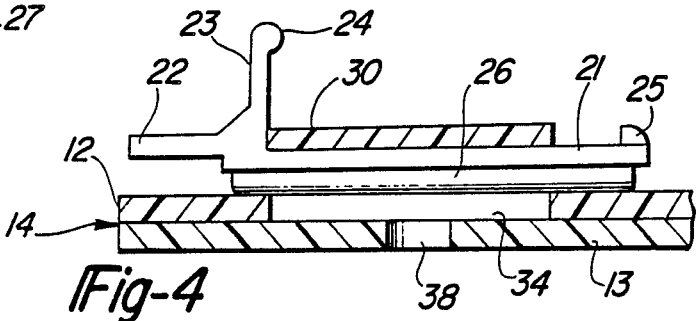
FIG. 4 is a cross-sectional plan view of the slider positioned upon the door and taken as if in the direction of arrows 4—4 of FIG. 6.
Figure 6:
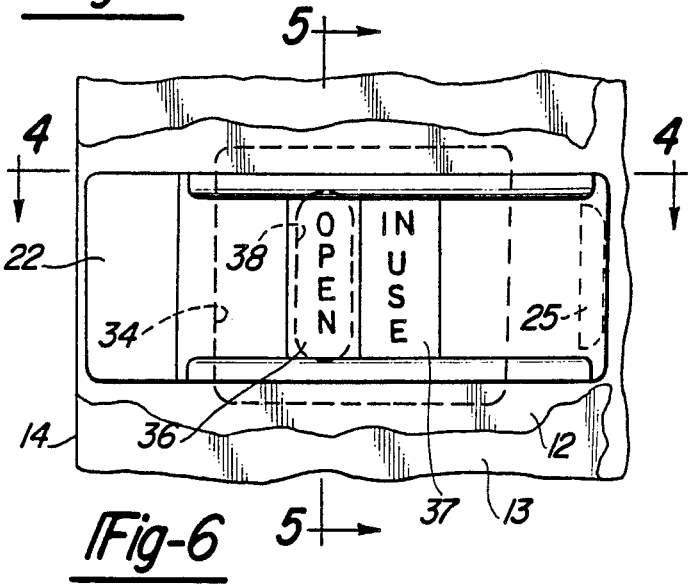
FIG. 6 is a fragmentary, elevational view of the slider portion of the door viewed from the outside of the door and is taken as if in the direction of arrows 6—6 of FIG. 1.

Because of the struck-out loop, the area of the panel 12 from which the loop is cut or struck-out leaves an opening 34 (see FIGS. 4 and 6). Thus, the outer surface of the slider, which is located between the flanges or runners 26, is exposed to view through that opening 34.

An indicia band 36 and an adjacent indicia band 37 is applied upon the exposed surface of the slider. Each indicia band is intended to give a message which is visible through a vertical elongated, narrow window opening 38 formed in the portion of the cover panel 13 which overlies the slider. By way of example, one indicia band 36 may state "open" while another may state "in use" or similar messages.

Figure 2:
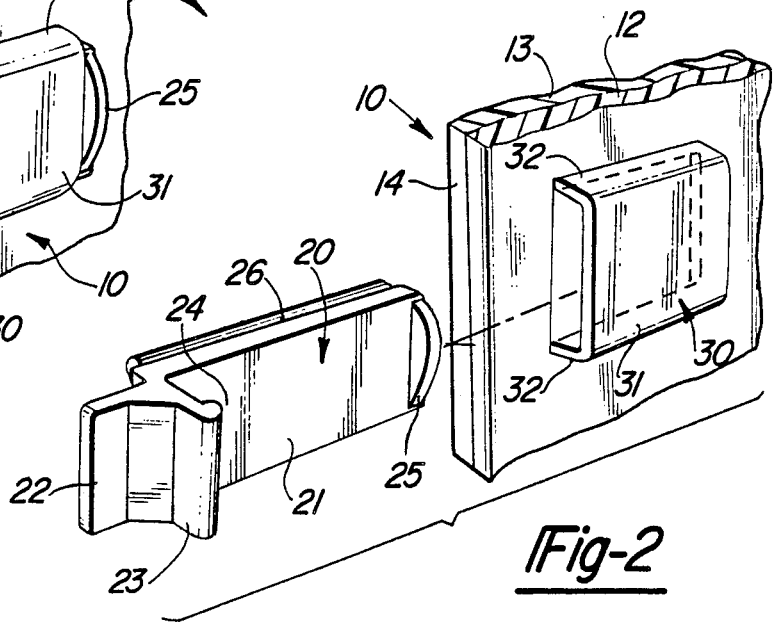
FIG. 2 is a perspective, fragmentary view of the door edge with the latch slider pulled out from the door slider receptacle or guide loop.
Figure 3:
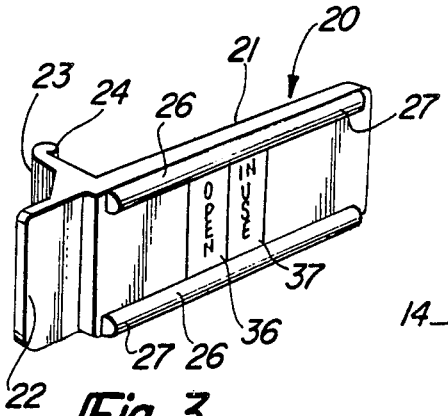
FIG. 3 is a perspective view of the front face of the slider.

In operation, the slider 20 is mounted within the receptacle or loop 30 by positioning it as shown in FIG. 2 at the leading edge of the door. Then, the slider is manually pushed through the loop so that its rear rib 25 is forcibly slid through the loop. The force of the moving rib, which has a curved end portion, causes the loop base to momentarily deflect resiliently, as it is made out of a plastic which has some inherent resiliency, so that the rib passes through the loop. After the rib 25 passes through the loop, it functions as a stop means or limit means to limit the sliding movement of the slider in the direction of the jamb. The movement of the slider away from the jamb-like member is limited by the hand grip flange 23 which forms a stop means for the opposite direction (See FIG. 4).

When the slider is moved into latching position where its tongue overlaps the jamb-like member 11, or fits into a suitable socket in the jamb-like member 11, the indicia band 37, which illustratively states "in use" is visible through the window opening 38 in the cover panel 13 to a person standing outside of the cabana and looking at the outside surface of the door. Conversely, when the slider is slid into the unlatching position (as in FIG. 4), the indicia band 36 is visible through the window opening 38 to state "open" or the like to one standing on the outside of the cabana.

Figure 5:
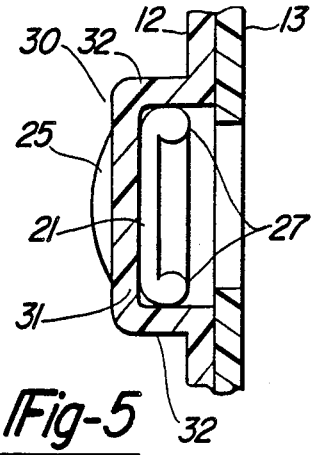
FIG. 5 is a cross-sectional end view of the slider mounted upon the door and taken as if in the direction of arrows 5—5 of FIG. 6.

The rounded edge surface 27 of the flanges 26 minimize the frictional contact between the slider and the body of the plastic inner panel 12. In addition, as shown in FIG. 5, the curvature of the sides of the rounded flanges reduce their areas of contact with the inner surfaces of the legs 32 of the loop 30. Thus, the slider is somewhat like a sled whose runners contact the snow along narrow lines or bands to reduce the amount of friction and thereby enable movement with less force.

The integral flanges 26 not only function as runners to enable easier movement of the slider, but also form reinforcing edge flanges which rigidify the thin body portion 21 of the slider. Moreover, the flanges resist bending, twisting or warping of the latch which may othewise result from substantial changes in weather conditions, as for example, sharp changes in temperature.

While the latch of this invention is illustrated as used with a toilet cabana or a similar type of outhouse construction, it may also be usable in other structures. Thus, it is desired that the invention herein be construed in accordance with the attached claims.

Having fully described an operative embodiment of this invention, we now claim:

1. A cabana or outhouse structure, comprising:

a panel being hinged and having a leading edge, said panel being formed of a plastic sheet like material;

a jamb-like member being alinged with the leading edge of the panel;

a slide latch mechanism including an elongated, generally flat, wide slider;

said slider including a body portion, said slider arranged upon a surface of the panel for sliding in its lengthwise direction into latching engagement with an adjacent portion of the jamb-like member;

said body portion of said slider having a first end, a second end, two surfaces opposite one another and two elongated side edges opposite one another running the length of said body portion between said first end and said second end;

at least one integral, rigid rib formed upon the surface of the body portion of the slider that faces said panel surface at each of the elongated side edges of the body portion of the slider;

said ribs being of substantially uniform, narrow cross-section along their lengths and each having a free edge surface which overlies and slidably engages their adjacent panel surface portions, with the body portion of the slider being otherwiseout of engagement with said panel surface;

a flattened, open-ended loop being struck-out of said panel, and with the body portion of the slider extending through the loop, for holding the body portion of the slider upon the panel and guiding its sliding movement;

whereby the ribs form sled-like runners on the body portion of the slider for reducing the friction between the body portion of the slider and the panel surface and simultaneously rigidifying and reinforcing the body portion of the slider against bending, twisting and warping;

a tongue integral with said body portion extending from said first end of said body portion substantially parallel to the surface of the body portion that faces said panel surface, said tongue engagable with the jamb-like member;

a raised stop integral with said body portion extending from said second end of said body portion substantially normal to the surface of said body portion opposite said surface that faces said panel, said raised stop having and end with the end of said stop being engagable with said loop to limit the sliding movement of the slider towards the jamb-like member;

a grip flange integral with said body portion extending from said first end of said body portion substantially normal to the surface of said body portion that faces said panel, said grip flange located between said tongue and said body portion such that said loop is located between said grip flange and said raised stop so that said grip flange abuts said jamb-like member when said slider is moved towards said jamb-like member and said grip flange limits the movement of the slider when said slider is moved away from said jamb-like member; and an indicia applied upon the surface of said body portion that faces said panel surface between said ribs so that preselected portions of the indicia are visible through a window-like opening formed in said panel overlying said slider, with the position of the preselected portion of the indicia depending upon whether the slider is arranged in a latching position or an unlatching position.

2. A cabana or outhouse structure as defined in claim 1, wherein said slider is integrally formed of a plastic material which is characterized by being relatively slippery at the exposed surfaces of the slider.

3. A cabana or outhouse structure as dedfined in claim 2, wherein the free edges of said ribs are rounded in cross-section for forming a narrow band in substantially line contact with said adjacent panel surface portions.

4. A cabana or outhouse structure as defined in claim 3, wherein said loop being formed of a resiliently flexible material, so that the slider may be forcibly inserted endwise through the loop, with the raised stop sliding through the loop and temporarily displacing the loop material for passage of the raised stop therethrough, so that the latch may be manually formed or positioned within the loop.

5. A cabana or outhouse structure as defined in claim 4, wherein said loop is resiliently flexible, so that it will resiliently yield to permit at least one of the ends of the raised stop to be forced through the loop when the slider is endwise slid through the loop for internal insertion of or replacement of a slider when desired.

6. A slide latch for latching the leading edge of a panel of a cabana or outhouse structure to a jamb-like member, said panel being hinged with the leading edge of the panel arranged to be aligned with the jamb-like member, comprising:

an elongated, generally flat, wide slider including a body portion, said slider arranged upon a surface of the panel for sliding in its lengthwise direction into latching engagement with an adjacent portion of the jamb-like member;

said body portion having a first end, a second end, two surfaces opposite one another and two elongated side edges opposite one another running the length of said body portion between said first end and said second end;

at least one integral, rigid rib formed upon the surface of the body portion of the slider that faces said panel surface at each of the elongated side edges of the body portion of the slider;

said ribs being of substantially uniform, narrow cross-section along their lengths and each having a free edge surface which overlies and slidably engages their adjacent panel surface portions, with the body portion of the slider being otherwise out of engagement with said panel surface;

a flattened, open-ended loop arranged on said panel surface, and with the body portion of the slider extending through the loop, for holding the body portion of the slider upon the panel and guiding its sliding movement;

whereby the ribs form sled-like runners on the body portion of the slider for reducing the friction between the body portion of slider and the panel surface and simultaneously rigidifying and reinforcing the body portion of the slider against bending, twisting and warping;

a tongue integral with said body portion extending from said first end of said body portion substantially parallel to the surface of the body portion that faces said panel surface, said tongue engagable with the jamb-like member;

a raised stop integral with said body portion extending from said second end of said body portion substantially normal to the surface of said body portion opposite said surface that faces said panel, said raised stop having and end with the end of said stop being engagable with said loop to limit the sliding movement of the slider towards the jamb-like member;

a grip flange integral with said body portion extending from said first end of said body portion substantially normal to the surface of said body portion that faces said panel, said grip flange located between said tongue and said body portion such that said loop is located between said grip flange and said raised stop so that said grip flange abuts said jamb-like member when said slider is moved towards said jamb-like member and said grip flange limits the movement of the slider when said slider is moved away from said jamb-like member; and an indicia applied upon the surface of said body portion that faces said panel surface between said ribs so that preselected portions of the indicia are visible through a window-like opening formed in said panel overlying said slider, with the position of the preselected portion of the indicia depending upon wether the slider is arranged in a latching position or an unlatching position; and said loop being struck-out from the panel to form said window-like opening.

7. A slide latch as defined in claim 6, and said slider being integrally formed of a plastic material which is characterized by being relatively slippery at the exposed surfaces of the slider.

8. A slide latch as defined in claim 6, wherein the free edges of said ribs are rounded in cross-section for forming a narrow band, in substantially line contact with said adjacent panel surface portions.

9. A slide latch as defined in claim 6, wherein said loop is formed of a resiliently flexible material, so that the slider may be forcibly inserted endwise through the loop, with the raised stop sliding through the loop and temporarily displacing the loop material for passage of the raised stop therethrough, so that the latch may be manually formed or positioned within the loop.

10. A slide latch as defined in claim 9, and said panel being formed of a plastic sheet-like material.

* * * * *